US008656875B2

(12) United States Patent
Boese

(10) Patent No.: US 8,656,875 B2
(45) Date of Patent: Feb. 25, 2014

(54) CELLULAR WHEEL

(75) Inventor: Olaf Boese, Nuremberg (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 149 days.

(21) Appl. No.: 13/026,402

(22) Filed: Feb. 14, 2011

(65) Prior Publication Data

US 2011/0197837 A1 Aug. 18, 2011

(30) Foreign Application Priority Data

Feb. 15, 2010 (DE) ..... 10 2010 008 003

(51) Int. Cl.
*F01L 1/344* (2006.01)

(52) U.S. Cl.
USPC ..... 123/90.17

(58) Field of Classification Search
USPC ..... 123/90.15, 90.17; 251/337; 464/160
See application file for complete search history.

(56) References Cited

U.S. PATENT DOCUMENTS 4,815,953 A * 3/1989 Iio ..... 418/179
4,858,572 A * 8/1989 Shirai et al. ..... 123/90.12
5,040,501 A * 8/1991 Lemelson ..... 123/188.3
5,055,016 A * 10/1991 Kawade ..... 418/179
5,163,872 A * 11/1992 Niemiec et al. ..... 464/2
6,129,063 A * 10/2000 Niethammer et al. ..... 123/90.17
6,386,167 B1 * 5/2002 Urckfitz et al. ..... 123/90.17
6,412,462 B1 * 7/2002 Lichti et al. ..... 123/90.17
6,457,447 B1 10/2002 Sato et al.
6,964,250 B2 * 11/2005 Wierl et al. ..... 123/90.17
7,305,949 B2 * 12/2007 McCarthy et al. ..... 123/90.17
7,717,074 B2 * 5/2010 Kleiber et al. ..... 123/90.17
2002/0139332 A1 * 10/2002 Takenaka ..... 123/90.17
2007/0245994 A1 * 10/2007 Methley ..... 123/90.17
2008/0226938 A1 * 9/2008 Chaney et al. ..... 428/688
2009/0133650 A1 * 5/2009 Mizutani ..... 123/90.17

* cited by examiner

*Primary Examiner* — Kenneth Bomberg
*Assistant Examiner* — Jason T Newton
(74) *Attorney, Agent, or Firm* — Lucas & Mercanti, LLP; Klaus P. Stoffel

(57) ABSTRACT

A cellular wheel of a device for variably setting control times of gas exchange valves of an internal combustion engine, which has a cylindrical circumferential wall, a driving wheel that is arranged on an outer surface area of the circumferential wall, with a sealing cover that extends from an inner surface area of the circumferential wall radially inward, and a plurality of projections that extend from the inner surface area of the circumferential wall radially inward and from the sealing cover in an axial direction.

7 Claims, 2 Drawing Sheets

CELLULAR WHEEL

This application claims priority of DE 10 2010 008 003.9 filed Feb. 15, 2010, which is incorporated by reference herein.

FIELD OF THE INVENTION

The invention relates to a cellular wheel of a device for variably setting the control times of gas exchange valves of an internal combustion engine, with a cylindrical circumferential wall, with a driving wheel which is arranged on an outer surface area of the circumferential wall, with a sealing cover which extends from an inner surface area of the circumferential wall radially inward, and with a plurality of projections which extend from the inner surface area of the circumferential wall radially inward and from the sealing cover in the axial direction.

BACKGROUND OF THE INVENTION

In modern internal combustion engines, devices for variably setting the control times of gas exchange valves are used so that the phase relation between crankshaft and camshaft can be set variably, within a defined angular range, between a maximum advanced position and a maximum retarded position. The device is integrated into a drive train, by which torque is transferred from the crankshaft to the camshaft. This drive train may be implemented, for example, as a bolt, chain or gearwheel drive. Furthermore, the device is connected fixedly in rotation to a camshaft and has one or more pressure chambers, by means of which the phase relation between the crankshaft and camshaft can be varied in a directed manner. Conventionally, the devices are designed as pivoting motors of the vane cell type of construction, a cellular wheel being driven by the crankshaft and an impeller being connected fixedly in terms of rotation to the camshaft. In this case, the cellular wheel and the impeller form pressure chambers acting counter to one another. By the pressure medium being supplied to one group of pressure chambers, while at the same time pressure medium is discharged from the other group of pressure chambers, the phase relation of the impeller with respect to the cellular wheel and therefore of the camshaft with respect to the crankshaft can be set variably.

A device of this type is known, for example from U.S. Pat. No. 6,457,447 B1. The device has a cellular wheel, an impeller and a side cover, the cellular wheel being drive-connected to a crankshaft and the driven element being fastened fixedly in terms of rotation to a camshaft.

The cellular wheel is of pot-shaped design and has a cylindrical circumferential wall and a disk-shaped sealing cover which extends from the circumferential wall radially inward. Furthermore, the cellular wheel has a plurality of projections. The projections extend from the circumferential wall radially inward and from the sealing cover in the axial direction.

Within the pot-shaped structure is arranged the impeller which has an essentially cylindrically designed hub element and a plurality of vanes extending outward in the radial direction.

A side cover is arranged on the open side of the pot-shaped cellular wheel and is screwed to the latter. A plurality of pressure spaces are thus formed in the device and are delimited in the radial direction by the impeller and the circumferential wall, in the circumferential direction by adjacent projections and in the axial direction by the sealing cover and the side cover. A vane of the impeller extends into each of the pressure spaces, with the result that each of the pressure spaces is divided into two pressure chambers acting counter to one another.

Via a chain wheel which is formed on the side cover, the device is driven by the crankshaft by means of a chain drive while the internal combustion engine is in operation. By pressure be supplied to one group of pressure chambers, while at the same time pressure medium is discharged from the other pressure chambers, the phase position of the impeller with respect to the cellular wheel can be set variably.

OBJECT OF THE INVENTION

The object on which the present invention is based is to lower the outlay in terms of the production of the device and the load upon the latter.

SUMMARY OF THE INVENTION

The object is achieved, according to the invention, in that the circumferential wall, the driving wheel, the projections and the sealing cover are formed in one part. The device has a cellular wheel with a circumferential wall and with a sealing cover. The sealing cover extends from an inner surface area of the circumferential wall radially inward and is designed to be essentially disk-shaped, as a rule in the form of an annular disk with a central orifice. The circumferential wall and sealing cover thus form a pot-shaped structure.

Furthermore, projections are provided on the cellular wheel and extend from the inner surface area of the circumferential wall radially inward and from the sealing cover in the axial direction. After an impeller has been inserted into the pot-shaped structure, the projections delimit pressure chambers of a hydraulic actuating drive in the circumferential direction of the cellular wheel. For this purpose, the inside diameter, defined by the projections, of the cellular wheel is adapted to the outside diameter of a cylindrical surface of the impeller.

Moreover, a driving wheel is provided, for example a chain wheel, belt wheel or gearwheel, which is driven by a drive means, for example a chain, belt or gearwheel, of the crankshaft. The cellular wheel is set in rotation by the crankshaft via the driving wheel when the internal combustion engine is in operation. The torque transferred to the cellular wheel is transferred via the hydraulic actuating drive to an impeller received in the cellular wheel, the phase position between the impeller and cellular wheel being capable of being set variably within a defined angular range. The impeller is drive-connected to the camshaft, so that the torque is transferred to the latter. In this case, conventionally, the impeller is connected fixedly in terms of rotation to the camshaft.

It is provided for the circumferential wall, the driving wheel, the projections and the sealing cover to be formed in one part. The functionalities of these subcomponents are thus integrated in one component. This component may be produced, for example, in a sintering operation or a (metal or plastic) injection molding operation without the use of a tool and therefore neutrally in terms of cost. While the device is being mounted, the driving wheel no longer has to be connected to the other components, for example an outer surface area of the circumferential wall.

In comparison with embodiments in which the driving wheel is connected in one part to a side cover which is fastened by means of screws to the open end of the pot-shaped structure, the load upon the side cover is reduced. This can therefore be made thinner, with the result that the mass moment of inertia of the device can be lowered. By the pot-shaped structure being formed in one part with the driving wheel, there is no need, while the device is being assembled, to position the driving wheel with respect to the circumferential wall in order to avoid concentricity errors.

In a development of the invention, it is proposed that a locking means be received or formed in the cellular wheel, by which locking means a releasable mechanical coupling can be provided between the cellular wheel and an impeller of the device. Such mechanical coupling is required when the device is supplied only insufficiently with pressure medium, for example when the internal combustion engine is being started or when it is idling under hot conditions. For this purpose, conventionally, two locking means are provided, one of the locking means being arranged in the cellular wheel or the impeller and the other locking means being formed on the other component. For example, a displaceably mounted locking piston may be provided in the cellular wheel or impeller and can engage into a slot on the other component. In embodiments in which the driving wheel is formed on a side cover screwed to the cellular wheel, the torque transferred from the crankshaft to the driving wheel is transferred via the screw connection to the cellular wheel and subsequently via the locking means to the impeller. The loads occurring in these operating phases overshoot the normal operating loads considerably. The screw connection between the cellular wheel and side cover must be designed so that this withstands the loads. By virtue of the proposed innovation, the side cover no longer lies in the torque transfer path, and therefore the screw connection can be designed for lower loads. Selected thread sizes and screw strength can therefore be lower, with the result that additional degrees of freedom in the design of the device are acquired and the production costs are reduced.

Furthermore, there may be provision for at least the driving wheel to be provided with a wear protection layer. The driving wheel may be provided, for example, with a diamond coating, for example a C22+ coating. Hardness-increasing treatments, such as carbon nitriding or steam treatment, may likewise be envisaged. A beneficial material can thus be used for the cellular wheel, the highly loaded driving wheel being protected against wear.

Alternatively, there may be provision for the cellular wheel to be produced from a material of sufficient basic hardness, for example a silicon-enriched aluminum material or a glass fiber or mineral fiber reinforced plastic.

BRIEF DESCRIPTION OF THE DRAWINGS

Further features of the invention may be gathered from the following description and from the drawings which illustrate an exemplary embodiment of the invention in simplified form and in which.

DETAILED DESCRIPTION OF THE DRAWINGS

Figure 1:
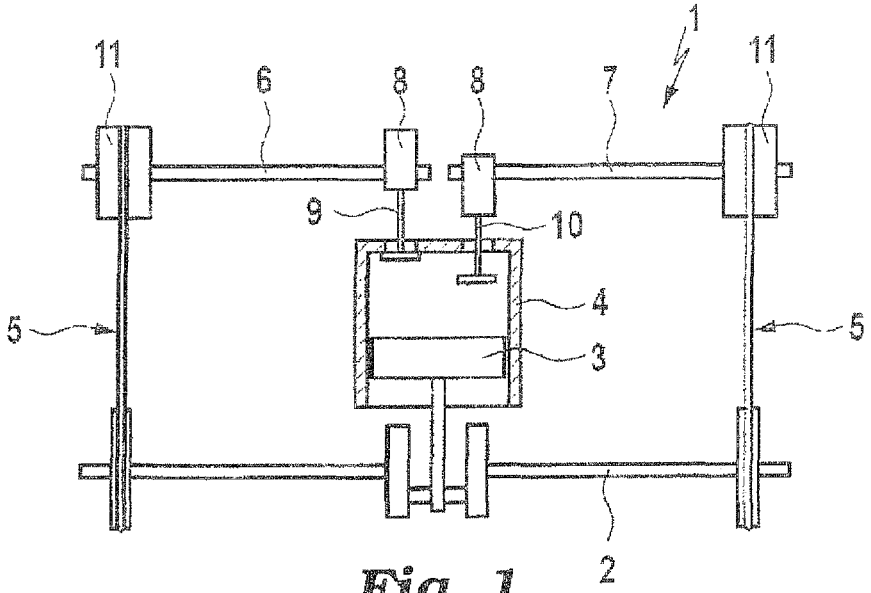
FIG. 1 shows an internal combustion engine only highly diagrammatically.

An internal combustion engine 1 is shown in FIG. 1 with a piston 3 seated on a crankshaft 2 which is indicated in a cylinder 4. The crankshaft 2, in the embodiment illustrated, is connected by a traction drive 5 to an inlet camshaft 6 and an outlet camshaft 7. A first and a second device 11 are capable of ensuring relative rotation between the crankshaft 2 and camshafts 6, 7. Cams 8 of the camshafts 6, 7 actuate one or more inlet gas exchange valves 9 or one or more outlet gas exchange valves 10. There may likewise be provision for equipping only one of the camshafts 6, 7 with the device 11 or for providing only one camshaft 6, 7 which is equipped with the device 11.

Figure 2:
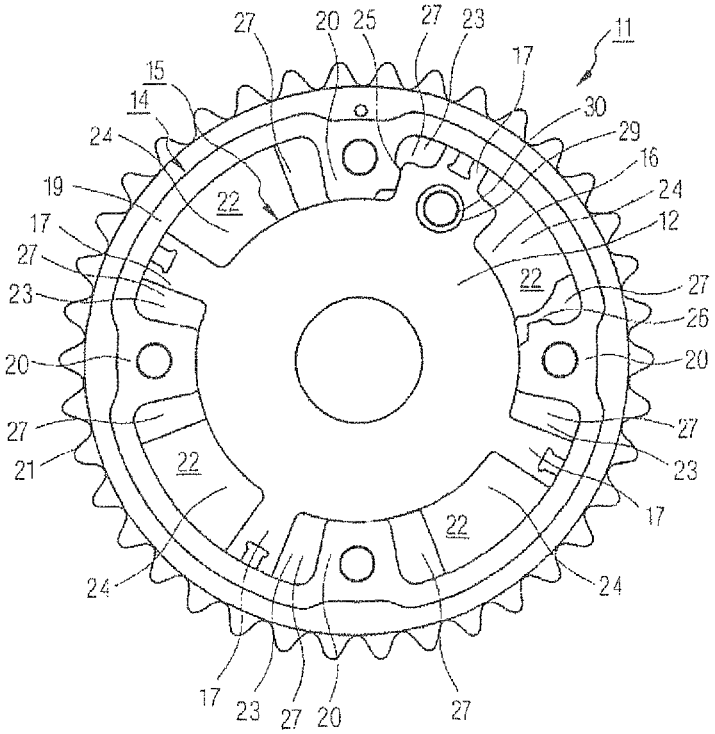
FIG. 2 shows a top view of a device according to the invention for variably setting the control times of gas exchange valves in an internal combustion engine along the axis of rotation of the device.

FIG. 2 shows a device 11 according to the invention in a top view along the axis of rotation of the device 11. Conventional devices 11 are known, for example, from U.S. Pat. No. 6,457,447 B1. The device 11 has a cellular wheel 14, an impeller 15 and a side cover, not illustrated. The impeller 15 has an essentially cylindrically designed hub element 12, from the outer cylindrical surface area of which four vanes 17 extend outward in the radial direction.

Figure 4:
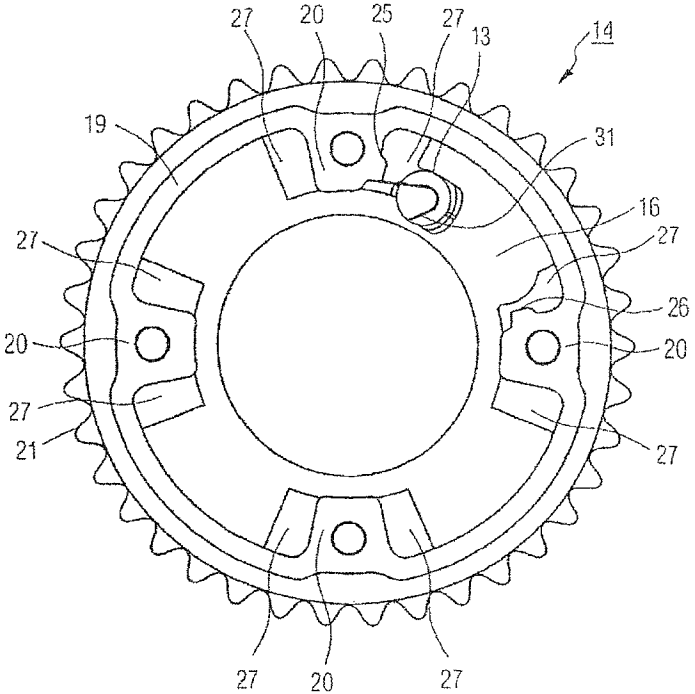
FIG. 4 shows a top view of the cellular wheel from FIG. 3.
Figure 3:
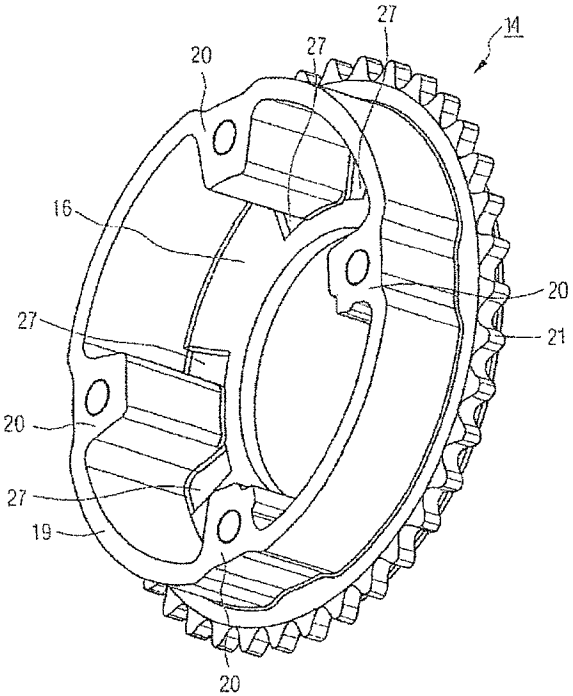
FIG. 3 shows a perspective view of a cellular wheel according to the invention of the device from FIG. 2.

The cellular wheel 14 has a cylindrical circumferential wall 19, from the inner surface area of which four projections 20 extend radially inward (FIGS. 3 and 4). Furthermore, a sealing cover 16 in the form of an annular disk is provided, which is formed on an axial side face of the circumferential wall 19. The sealing cover 16 extends from the circumferential wall 19 radially inward, and it projects radially inward beyond the projections 20. A pot-shaped structure is thus formed by the sealing cover 16 and the circumferential wall 19. Furthermore, the device 11 has a side cover, not illustrated, which is arranged on the open axial side face of the pot and which is screwed to the pot. A driving wheel, a chain wheel 21 in the embodiment illustrated, is formed on an outer surface area of the circumferential wall 19. The cellular wheel 14 is produced from sintered steel, the chain wheel 21 being provided with a wear protection layer which has been produced by means of a carbon nitriding method. Alternatively, the cellular wheel may also be produced from a material of sufficient basic hardness. What may be considered are, for example, glass or mineral fiber reinforced plastics or a silicon-enriched aluminum material.

The projections 20 extend from the sealing cover 16 in the axial direction into the pot-shaped structure of the cellular wheel 14 and bear against the side cover, not illustrated.

The cellular wheel 14 is formed as a sintered component, the sealing cover 16, the projections 20 and the chain wheel 21 being produced in one part with the circumferential wall 19. In this case, the geometry of the cellular wheel 14 is designed in such a way that the latter can be produced completely by means of a sintering operation without the use of a tool.

In the mounted state, the impeller 15 is arranged within the pot-shaped structure formed by the circumferential wall 19 and by the sealing cover 16. In this case, the inside diameter of the projections 20 is adapted to the outside diameter of the hub element 12. A pressure space 22 is formed in each case between two projections 20 adjacent in the circumferential direction. Each of the pressure spaces 22 is delimited in the circumferential direction by opposite, essentially radially running boundary walls of adjacent projections 20, in the axial direction by the sealing cover 16 and the side cover, not illustrated, radially inward by the hub element 12 and radially outward by the circumferential wall 19. A vane 17 projects into each of the pressure spaces 22, the vanes 17 being designed in such a way that they bear both against the sealing cover 16 and the side cover and against the circumferential wall 19. Each vane 17 thus divides the respective pressure space 22 into two pressure chambers 23, 24 acting counter to one another.

While the internal combustion engine 1 is in operation, the cellular wheel 14 is set in rotation, by means of the chain wheel 21, by the crankshaft 2 via the chain drive 5. The impeller 15 is connected fixedly in rotation to a camshaft 6, 7.

The impeller 15 is arranged rotatably with respect to the cellular wheel 14 within a defined angular range. The angular range is limited in one direction of rotation of the impeller 15 in that one of the vanes 17 comes to bear against a first stop 25 of a projection 20. Similarly, the angular range is limited in the other direction of rotation in that the vane 17 comes to bear against a second stop 26 of a projection 20.

The action of pressure upon one group of pressure chambers 23, 24 and the relief of pressure from the other group make it possible to vary the phase position of the cellular wheel 14 with respect to the impeller 15 and consequently the phase position of the camshaft 6, 7 with respect to the crankshaft 2. By the action of pressure upon both groups of pressure chambers 23, 24, the phase position can be kept constant. Axial depressions 27 are formed on the sealing cover 16 adjacently to the projections 20 in the circumferential direction, in order to prevent the vanes 17 from being jammed in one of the end positions in a phase between the sealing cover 16 and the projections 20.

The sealing cover 16 has a locking means, in the embodiment illustrated a slot 13 in the form of a round axial recess. Furthermore, one of the vanes 17 has formed in it a receptacle 29 in which a locking piston 30 is arranged axially displaceably. The locking piston 30 is acted upon with force in the direction of the sealing cover 16 by means of a spring element, not illustrated. When the slot 13 and the locking piston 30 stand opposite one another in the axial direction, the spring element forces the locking piston 30 into the slot 13, so that the locking piston 30 is arranged both in the slot 13 and in the receptacle 29. A releasable mechanical connection of the impeller 15 to the cellular wheel 14 is thus implemented, which prevents a variation of the phase position of the impeller 15 with respect to the cellular wheel 14. If a control unit of the internal combustion engine 1 demands phase adjustment, a pressure medium is supplied to the slot 13 via a pressure medium duct 31, with the result that the locking piston 30 is forced back into the receptacle 29 and therefore the mechanical coupling of the impeller 15 to the cellular wheel 14 is released. Subsequently, by the action of pressure upon one group of pressure chambers 23, 24, while at the same time pressure upon the other pressure chambers 23, 24 is relieved, the phase position is set.

REFERENCE SYMBOLS

1 Internal combustion engine
2 Crankshaft
3 Piston
4 Cylinder
5 Traction drive
6 Inlet camshaft
7 Outlet camshaft
8 Cam
9 Inlet gas exchange valve
10 Outlet gas exchange valve
11 Device
12 Hub element
13 Slot
14 Cellular wheel
15 Impeller
16 Sealing cover
17 Vane
19 Circumferential wall
20 Projection
21 Chain wheel
22 Pressure space
23 First pressure chamber
24 Second pressure chamber
25 First stop
26 Second stop
27 Depression
29 Receptacle
30 Locking piston
31 Pressure medium duct

The invention claimed is:

1. A cellular wheel of a device for variably setting control times of gas exchange valves of an internal combustion engine, comprising:

a cylindrical circumferential wall;

a driving wheel, which is arranged on an outer surface area of the circumferential wall;

a sealing cover, which extends from an inner surface area of the circumferential wall radially inward at an axial side of the circumferential wall; and a plurality of projections, which extend from the inner surface area of the circumferential wall radially inward and extend from the sealing cover in an axial direction, each of the projections having two opposing circumferential sides, wherein the circumferential wall, the driving wheel, the projections, and the sealing cover are combined to form a single part, and wherein axial depressions are formed on the sealing cover adjacent each circumferential side of each of the projections.

2. The cellular wheel according to claim 1, wherein the device has an impeller, and further comprising a locking means for providing a releasable mechanical coupling between the cellular wheel and the impeller of the device.

3. The cellular wheel according to claim 2, wherein the locking means includes a slot in the sealing cover and a locking piston, the slot being connected to one of the axial depressions.

4. The cellular wheel according to claim 1, wherein at least the driving wheel has a wear protection layer comprising a diamond coating.

5. The cellular wheel according to claim 1, wherein the cellular wheel is made of a silicon-enriched aluminum material.

6. The cellular wheel according to claim 1, wherein the cellular wheel is made of a glass fiber or mineral fiber reinforced plastic.

7. A device for variably setting control times of gas exchange valves of an internal combustion engine, the device comprising a cellular wheel having a cylindrical circumferential wall; a driving wheel, which is arranged on an outer surface area of the circumferential wall; a sealing cover, which extends from an inner surface area of the circumferential wall radially inward; and a plurality of projections, which extend from the inner surface area of the circumferential wall radially inward and extend from the sealing cover in an axial direction, each of the projections having two opposing circumferential sides, wherein the circumferential wall, the driving wheel, the projections, and the sealing cover are combined to form a single part, and wherein axial depressions are formed on the sealing cover adjacent each circumferential side of each of the projections.

* * * * *